US006616204B1

(12) United States Patent
Mitts et al.

(10) Patent No.: US 6,616,204 B1
(45) Date of Patent: Sep. 9, 2003

(54) ADJUSTABLE MOUNTING PLATE

(75) Inventors: Richard K. Mitts, Fullerton, CA (US); Norbert A. Markl, Placentia, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/519,797

(22) Filed: Mar. 6, 2000

Related U.S. Application Data

(60) Provisional application No. 60/135,682, filed on May 24, 1999.

(51) Int. Cl.[7] ..... E05B 15/02
(52) U.S. Cl. ..... 292/341.18; 292/340
(58) Field of Search ..... 292/341.18, 540, 292/341.12, 341.15, 288; 70/257

(56) References Cited

U.S. PATENT DOCUMENTS

| | | | | | |
|---|---|---|---|---|---|
| 1,245,617 | A | * | 11/1917 | Prinzler | 292/341.18 |
| 2,993,719 | A | * | 7/1961 | Manchester | 292/341.18 |
| 3,316,007 | A | * | 4/1967 | Russell | 292/341.18 |
| 3,416,829 | A | * | 12/1968 | Russell et al. | 292/341.18 |
| 4,017,106 | A | * | 4/1977 | Salazar | 292/340 |
| 4,183,568 | A | * | 1/1980 | Ferracane | 292/341.18 |
| 4,357,005 | A | * | 11/1982 | Bourke | 267/144 |
| 4,367,976 | A | * | 1/1983 | Bowman | 404/68 |
| 4,602,813 | A | | 7/1986 | Gergoe et al. | |
| 4,627,651 | A | * | 12/1986 | Grimbly | 292/288 |
| 4,813,724 | A | * | 3/1989 | Dietrich | 292/341.12 |
| 5,193,868 | A | * | 3/1993 | O'Toole | 292/257 |
| 5,806,355 | A | * | 9/1998 | Lanigan et al. | 70/257 |
| 5,833,064 | A | * | 11/1998 | Ayres et al. | 206/340 |
| 6,140,894 | A | * | 10/2000 | Lane | 335/16 |
| 6,241,200 | B1 | * | 6/2001 | Camporeale et al. | 248/68.1 |
| 6,327,878 | B1 | * | 12/2001 | Levenson | 292/288 |

FOREIGN PATENT DOCUMENTS

| | | |
|---|---|---|
| DE | 30 26 174 | 2/1981 |
| GB | 2 114 642 | 3/1933 |

* cited by examiner

*Primary Examiner*—Robert J. Sandy
*Assistant Examiner*—André L. Jackson
(74) *Attorney, Agent, or Firm*—Mark W. Croll; Paul F. Donovan

(57) ABSTRACT

An automotive vehicle door striker plate (10) includes first and second plate parts (22,24) coupled together by an edge flange (26). A continuous slot (28) separates the plate parts except for two bendable portions (30,32). In use, second plate part (24) is welded to a door closing surface in predetermined arrangement then the door has certain manufacturing operations. Next, the door is removed from the body for accessory mounting (e.g., windows). Finally, on reattachment of the door to the body, any reattachment positional adjustment is accomplished by bending the portions (39, 32) by force application.

20 Claims, 3 Drawing Sheets

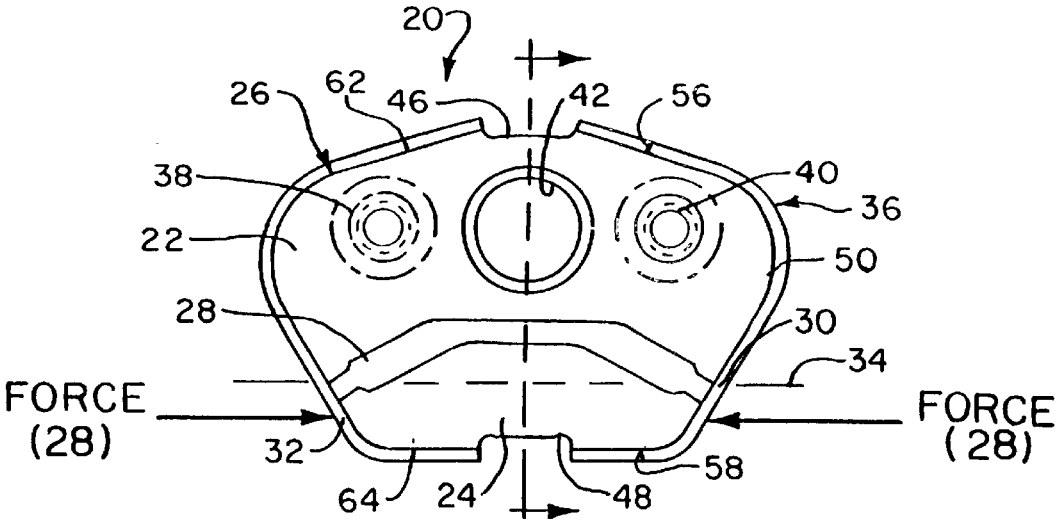
FIG. 1
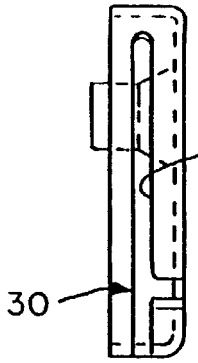
FIG.2
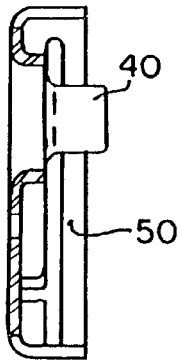
FIG.3
FIG.4
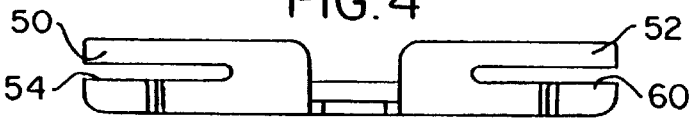
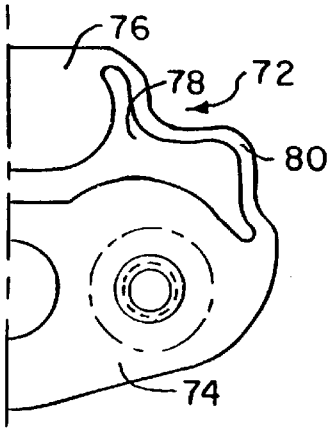
FIG.5
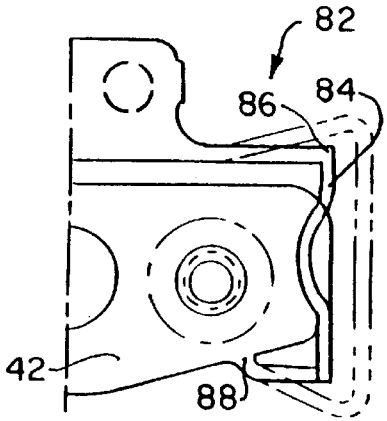
FIG.6

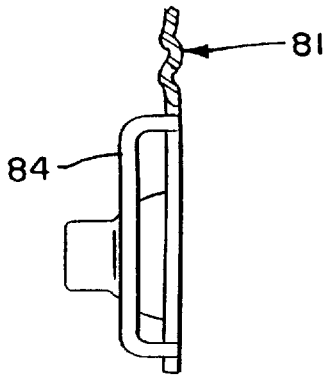
FIG.7
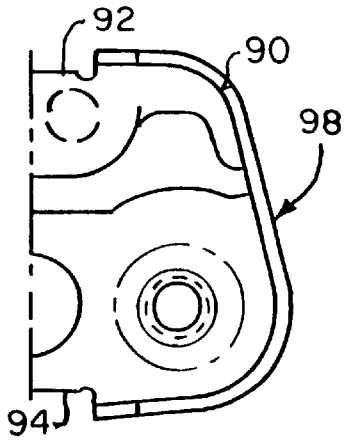
FIG.8
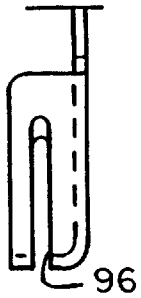
FIG.9
FIG.10
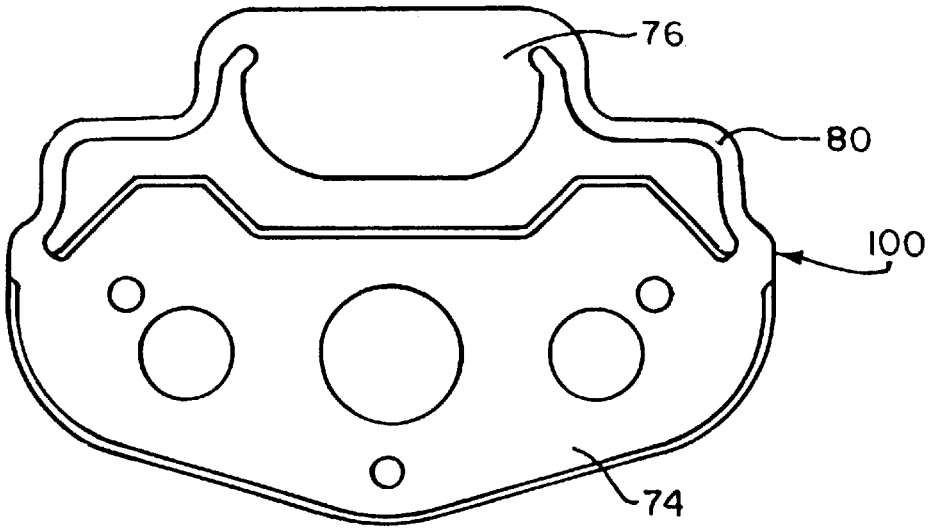

ADJUSTABLE MOUNTING PLATE

This application claims the benefit of Provisional application Ser. No. 60/135,682, filed May 24, 1999.

BACKGROUND

1. Field of the Invention

The present invention relates generally to a plate such as a door strike for an automotive vehicle that is welded to a surface of an object during manufacture and to which plate hardware is mounted, and, more particularly, to such a plate that can provide subsequent repositioning of the hardware without disturbing the welded arrangement integrity.

2. Description of Related Art

In the manufacture and assembly of an automotive vehicle body, the door and related parts (e.g., strike plate) are first assembled to the vehicle body for painting nd rust-proofing ("E-coating"). After this, the door is disassembled from the body and provided with accessories (e.g., windows, door locks and other hardware, textile or leather interior covering). Reattachment of the accessoried door to the body can result in damage to door paint or to the accessories if the reattachment requires positional adjustment.

It is therefore a desideratum to provide a means for readjusting a plate previously welded to an object with a minimum effect on adjacent equipment or hardware carried thereby.

OBJECT AND SUMMARY OF THE INVENTION

A primary aim and object of the invention is to provide a door strike or striker plate for an automotive vehicle door which can be subsequently adjusted from an initial fixed positioning arrangement.

In accordance with the practice of the present invention there is provided a door strike including first and second plates integrally interconnected by a peripheral edge flange. A slot generally separates the two plate parts except for readily deformable flange portions adjacent opposite peripheral edges of the strike. A guide opening and at least one threaded sleeve are formed in the first plate part for receiving hardware mounted thereto.

Initially during manufacture, the second plate part is welded or otherwise fixedly secured to a desired surface (e.g., door closing surface). Typically, the door has a rust-proof coating applied and the door painted, after which the door is removed and accessories (e.g., windows, locks) are mounted to the door at a different work site. When the door is once again mounted to the vehicle body door opening, it may be necessary to effect slight adjustment of the striker plate mounting arrangement, and this can be done with the described striker plate by applying adjustment corrective force to the second plate part which bends the deformable portions the required amount for correct positioning of the strike plate.

A second version of the invention includes plate parts of a steel that is not heat-hardened and, in addition, has sinuous-shaped deformable portions providing enhancement of angular adjustment extent. In a third version, connecting arms between the plate parts forming a 3-dimensional configuration provide further ease of realignment in certain situations. A fourth version also is constructed of steel that is not heat treated and includes a slotted edge flange deformable for adjustment as needed. In a fifth version, the two plate parts are not heat treated and further heat-hardened plate is suitably connected to one of the two plate parts providing increased thread strength for a retaining bolt and overall rigidity.

BRIEF DESCRIPTION OF THE DRAWING

In the accompanying drawing:

FIG. 1 is a front elevational view of the present invention;

FIG. 2 is a right side elevational view of FIG.

FIG. 3 is a partially sectional, left side elevational view of FIG. 1;

FIG. 4 is a top plan view;

FIG. 5 is a frontal view of a second embodiment;

FIG. 6 is a frontal view of a third embodiment;

FIG. 7 is a partially sectional, right side elevational view of the embodiment of FIG. 6;

FIG. 8 is a frontal view of a fourth embodiment;

FIG. 9 is a top plan view of FIG. 8;

FIG. 10 is a frontal view of a partly assembled fifth version of the invention;

DESCRIPTION OF PREFERRED EMBODIMENTS

Figure 11:
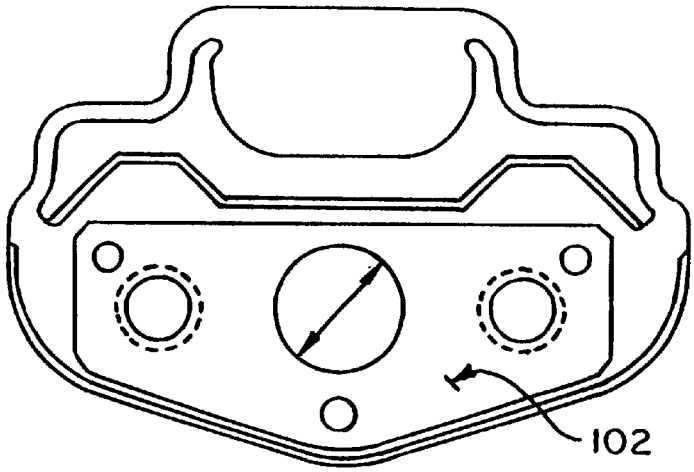
FIGS. 11 and 12 are frontal views of a final assembly of the FIG. 10 version and a bottom elevational view of FIG. 10, respectively.

Turning now to the drawing, and particularly FIGS. 1–4, a first version adjustable mounting plate 20 of this invention is seen to include first and second plate parts 22 and 24 unitarily coupled together by an outer edge flange 26. The two plate parts and flange are formed from a single sheet of metal, which for this version is preferably steel. A continuous slot 28 separates the plate parts from one another. As will be more particularly described, the slot and detailed formation of the flange provide relatively narrow cross-section bendable portions 30 and 32 on opposite sides of plate 20 located adjacent the two outer ends of the slot 28. In essence, these bendable portions enable bending of the plate parts with respect to each other about the dashed bend line 34, either along this line or normally thereto by exerting a force 36 (arrows FIG. 1), for example.

The term "bendable" as used herein refers to a part being deformed to new geometric shape through the application of force, and when the force is removed the part retains the new shape.

Typically, the first plate part 22 will be provided with one or more threaded sleeves 38 and 40 or a guide opening 42 via which accessories or apparatus can be mounted. The second plate part 24 on the other hand is secured to a convenient wall member by welding, for example, providing a relatively fixed positional arrangement for the plate 20 to the door. In the case of an automotive door strike, the second plate part is welded to a door surface 44 that closes on the vehicle door opening (FIG. 13).

As can be seen best in the elevational views FIGS. 2–4, the flange 26 has a first gap 46 somewhat centered on the first plate part 22 and a second gap 48 centered on the second plate part 24, directly opposite the first gap. These gaps separate the flange into first and second flange parts 50 and 52. A first peripheral slot 54 in the flange part 50 extends between the points 56 and 58, respectively, slightly spaced from the two gaps. Similarly, a second peripheral slot 60 in flange part 52 extends from points 62 and 64 adjacent the two gaps.

Figure 13:
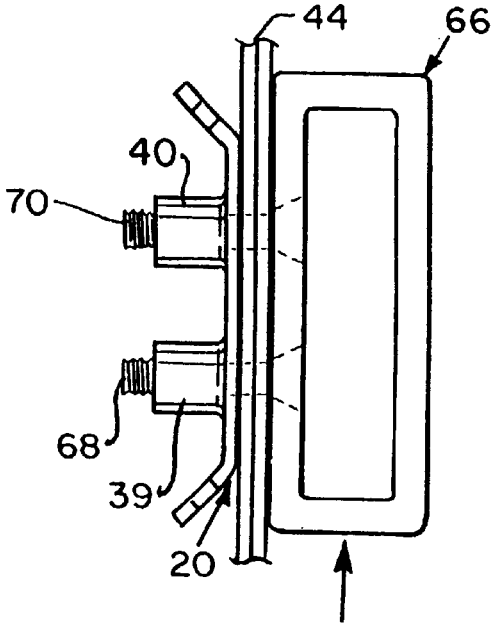
FIG. 13 is an elevational view showing the present invention in use.

For the ensuing description of invention use, reference is made to FIG. 13. As shown there, schematically depicted hardware 66 is mounted to the door surface 44 backed up by the strike plate 20 with bolts 68 and 70 extending through door surface openings and received within the threaded sleeves 39 and 40. The second plate part 24 is initially welded to the door. In the event hardware is removed for other door related procedures to be conducted, it may be necessary to readjust the mounting arrangement of the plate 20 after remounting of the hardware, and this can be accomplished by applying force to the hardware or mounting plate in desired direction so that the threaded sleeves or the guide opening will be properly located.

For a second version of this invention, reference is now made to FIG. 5 where the mounting plate is enumerated generally as 72. As in the first described version, the plate 72 includes a first plate part 74 and second plate part 76 separated by a slot 78 and integrally related by a pair of bendable portions 80 (only one of which is shown). The plate and bendable portions are constructed of a flat metal sheet lying generally in a common plane and do not include a flange as in the first version. Each bendable portion 80 is constructed in a generally elongated sinuous metal strip, the shape of which enhances adjustment bending when required. It is preferred that this version be constructed from a single metal sheet that is not heat treated.

The ensuing description of a third version of the invention is given with specific reference to FIGS. 6 and 7. As in the second version, this plate 82 has two generally flat plate parts lying substantially in a single plane (except for threaded sleeves) and separated by an intervening slot. However, a bendable portion 84 (only one of two is shown) that interconnects the plate parts to one another is elongated and formed with several curved parts that do not lie within the common plane of the plate parts (FIG. 7) Also, although one end 86 of the bendable portion 84 interconnects with a plate part adjacent the slot, the other end 88 interconnects with the other plate part at a point remote from the slot. The angular direction and amount of bending adjustment available is considerably enhanced by the described bendable portion construction.

It is contemplated that the third version can be further enhanced by forming the plate part surface 81 to be welded into a ripple-shape which enhances weldment integrity.

A fourth form of the invention is depicted in FIGS. 8 and 9 is similar to the first version in having a pair of plate parts separated by a slot and fully circumscribed by an edge flange 90 except for opposite side gaps 92 and 94. The flange differs, however, from that of the first version in that a peripheral slot 96 of uniform dimensions extends continuously along each half portion of the flange (e.g., FIG. 9) including each of bendable regions 98. This provides readjustment bending characteristics similar to the FIG. 1 version but requiring more force to achieve the same amount of bending.

Figure 12:
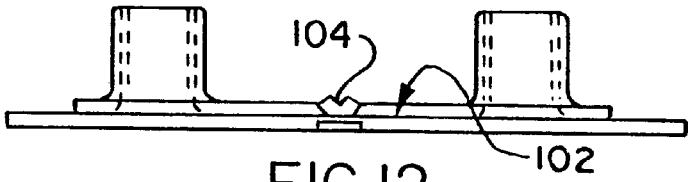

FIGS. 10, 11 and 12 pertain to a fifth version which includes a base plate 100 (FIG. 10) that can be constructed substantially identical to the second version mounting plate 72 shown in FIG. 5 and for that reason the same enumeration will be used. Plate 72 is preferably constructed of steel that has not been heat treated. An overlay strengthening plate part 102 preferably constructed of heat-hardened steel for added strength is secured onto the second plate part 74 by staked rivets 104, for example, and includes suitable openings for aligning with the threaded sleeves and guides opening of plate part 76. This version may be found especially advantageous for use on trucks, buses or other large vehicles whose doors are of a more rugged construction.

Although the present invention has been described with reference to preferred versions, it is to be understood that those skilled in the appertaining arts may suggest modifications that come within the spirit of the described invention and within the scope of the appended claims.

What is claimed is:

1. An adjustable mounting plate for attachment to an automotive vehicle door surface, the mounting plate comprising:

a first plate part;

a second plate part;

a deformable portion that interconnects the first plate part to the second plate part, such that a slot generally separates the first and second plate parts except for the deformable portion, wherein the first plate part is fixedly secured to the door surface, and wherein the second plate part is movable with respect to the first plate part by applying an adjustment corrective force to the plate so as to bend the deformable portion a required amount for proper positioning of the second plate part; and wherein the first and second plate parts and the deformable portion are made of a single piece of material.

2. A mounting plate as in claim 1, wherein the first and second plate parts and the deformable portion are formed from a single sheet of metal.

3. A mounting plate as in claim 1, wherein the deformable portion includes a first outer edge flange and a second outer edge flange, such that the first and second outer edge flanges hold the first and second plate parts together forming the slot therebetween.

4. A mounting plate as in claim 1, wherein the second plate part includes openings for mounting accessories thereto.

5. A mounting plate as in claim 1, wherein the deformable portion includes a strip of material of generally sinuous shape.

6. A mounting plate as in claim 1, wherein the first and second plate parts have surfaces which lie in a common plane, and wherein the deformable portion is elongated and formed with a plurality of curved portions that do not lie within the common plane of the first and second plate parts.

7. A mounting plate as in claim 1, wherein the deformable portion includes an outer edge flange that includes a peripheral slot.

8. A mounting plate as in claim 1, in which a further plate overlies a portion of and is secured to the second plate part.

9. A mounting plate as in claim 8, in which the first and second plate parts and deformable portion are constructed from a single piece of metal that is not heat-hardened, and the further plate is constructed from heat-hardened metal.

10. A mounting plate for fixed attachment to an automotive vehicle door surface in a predetermined arrangement, which arrangement can be subsequently modified without disturbing the integrity of the fixed attachment comprising:

a first plate part having a substantially flat surface adapted for fixed welded attachment to the door surface;

a second plate part including at least one threaded sleeve, a guide opening and a generally flat surface; and first and second bendable strips, each strip having opposite end portions integrally related to the respective plate parts such that the flat surfaces of the plate parts and the bendable strips lie substantially in a common plane.

11. A mounting plate as in claim 10, in which a further plate part has a surface contiguously contacting another surface of the second plate part and includes an opening aligned with the opening in the second plate part, and means for securing the further plate part to the second plate part, said further plate part being constructed of a heat-hardened steel.

12. A mounting plate for fixed attachment to an object in a predetermined arrangement, which arrangement can be subsequently modified without disturbing the fixed attachment, comprising:

a first plate part fixedly secured to the object;

a second plate part;

first and second bendable means interconnecting the first and second plate parts to one another; and the bendable means including a metal strip of generally sinuous shape, such that the second plate part is movable with respect to the first plate part by applying an adjustment corrective force to the plate so as to bend the bendable means a sufficient amount for proper positioning of the second plate part relative to the first plate part.

13. A mounting plate as in claim 12, in which the first and second bendable means hold the plate parts separated forming a slot therebetween.

14. A mounting plate as in claim 12, in which the first plate part includes openings for mounting accessories thereto and the second plate part is adapted for being secured to the object via a weldment.

15. A mounting plate as in claim 12, in which a further plate overlies the second plate part, and means for securing the further plate to said second plate part are provided.

16. A mounting plate as in claim 15, in which the securing means is a staked rivet.

17. A mounting plate as in claim 15, in which the plate parts and bendable means are constructed from a single piece of steel that is not heat-hardened and the further plate is constructed from heat-hardened steel.

18. A mounting plate as in claim 12, in which the first plate part includes at least one threaded sleeve and a guide opening.

19. A mounting plate as in claim 12, in which the first and second parts include a common outer edge flange with a peripherally extending slotted opening.

20. A mounting plate for fixed attachment to an object in a predetermined arrangement, which arrangement can be subsequently modified without disturbing the fixed attachment, comprising:

a first plate part fixedly secured to the object;

a second plate part; and an adjustable portion having one end attached to the first plate part and another end attached to the second plate part so as to interconnect the first plate part to the second plate part, wherein the second plate part is movable with respect to the first plate part by applying an adjustment corrective force to the plate so as to manipulate the adjustable portion a sufficient amount for proper positioning of the second plate part with respect to the first plate part.

* * * * *